US005608184A

United States Patent [19]

Machacek et al.

[11] Patent Number: 5,608,184

[45] Date of Patent: Mar. 4, 1997

[54] ALTERNATIVE USE OF MILITARY PROPELLANTS AS NOVEL BLASTING AGENTS

[75] Inventors: Oldrich Machacek, Dallas, Tex.; Gary R. Eck, Sarcoxie; J. Brent Gilion, Joplin, both of Mo.

[73] Assignee: Universal Tech Corporation, Dallas, Tex.

[21] Appl. No.: 383,526

[22] Filed: Feb. 3, 1995

[51] Int. Cl.[6] ..... C06B 25/26

[52] U.S. Cl. ..... 149/98; 149/100; 149/109.6; 588/202

[58] Field of Search ..... 149/98, 109.6, 149/100; 588/202

[56] References Cited

U.S. PATENT DOCUMENTS

| | | | |
|---|---|---|---|
| Re. 28,848 | 6/1976 | Clay et al. | 149/2 |
| 3,351,019 | 11/1967 | Schaadt et al. | 102/86.5 |
| 3,371,606 | 3/1968 | Cook et al. | 102/24 |
| 3,379,588 | 4/1968 | Corsi et al. | 149/98 |
| 3,637,444 | 1/1972 | Bonyata et al. | 149/10 |
| 3,637,445 | 1/1972 | Newman | 149/100 |
| 3,765,967 | 10/1973 | Funk et al. | 149/21 |
| 3,848,548 | 11/1974 | Bolejack, Jr. et al. | 110/7 R |
| 4,094,712 | 6/1978 | Goddard et al. | 149/10 |
| 4,139,404 | 2/1979 | Goddard et al. | 149/19.2 |
| 4,324,599 | 4/1982 | Range et al. | 149/98 |
| 4,528,049 | 7/1985 | Udy et al. | 149/21 |
| 4,555,276 | 11/1985 | Winston | 149/96 |
| 4,718,954 | 1/1988 | Machacek et al. | 149/46 |
| 5,291,831 | 3/1994 | Carney et al. | 102/318 |

*Primary Examiner*—Edward A. Miller
*Attorney, Agent, or Firm*—Henry D. Coleman; R. Neil Sudol

[57] ABSTRACT

The present invention relates to the unexpected discovery that the use of single base or triple base propellant of small grain size in combination with a detonator and a booster, produces a blasting agent which has considerable commercial value. The resulting blasting agent exhibits favorable cost for performance characteristics.

10 Claims, No Drawings

ALTERNATIVE USE OF MILITARY PROPELLANTS AS NOVEL BLASTING AGENTS

FIELD OF THE INVENTION

The present invention relates to a novel use that has been discovered for smokeless powder tactical munitions type gun propellants of the single base and triple base varieties. In the present invention, military propellants of this type which have shown little, if any, commercial viability are used as blasting agents on their own. In the present invention, it has been shown that these propellants are detonatable and become novel commercial blasting agents exhibiting a favorable cost for performance.

BACKGROUND OF THE INVENTION

For many years, the most common disposal method of military propellants has been open burning/open detonation or incineration. Each of these methods are disposal techniques for explosive materials. These methods suffer from limitations, not the least of which is the fact that these methods create emissions problems and regulatory concerns. Moreover, the underlying propellant, which has potential use, is simply wasted in these processes.

A substantial quantity of the military propellant source is destined for demilitarization and destruction in the next few years. The incorporation of a military propellant into a packaged explosive product offers the most controlled, safe and environmentaly sound method of disposing military propellants. Moreover, the alternative use of stored military propellants as commercial blasting agents would be an extremely economical means of disposing military propellants and in the process, producing industrial explosives exhibiting a favorable cost for performance.

In general, there are three types of smokeless powder military gun propellants: single base, double base and triple base. Single base propellants are made essentially of a single explosive material such as nitrocellulose, generally in combination with stabilizers and other additives such as plasticizers, burning rate modifiers and flash depressants. Double base propellants generally contain, in addition to nitrocellulose, a secondary explosive such as nitroglycerine or another nitroester generally in combination with one or more additives as described above. Triple base propellants, on the other hand, generally contain, in addition to nitrocellulose, substantial quantities of two other high explosives, such as nitroglycerine, nitroguanidine and HMX, among others generally in combination with one or more additives as described above.

Commercial explosives or blasting agents are used throughout the United States in mining industries (coal mining, quarrying, non-metal and metal mining) and in construction. According to the U.S. Bureau of Mines (BOM). More than 4 billion pounds of commercial explosives are used yearly in the United States. Practically all commercial explosives are presently based on ammonium nitrate.

OBJECTS OF THE INVENTION

It is an object of the invention to provide new blasting agents which incorporate quantities of readily available single base and triple base tactical munition type gun propellants.

It is also an object of the present invention to provide a method of making commercial blasting agents from readily available single base and triple base tactical munition type gun propellants.

It is a further object of the present invention to provide economical commercial blasting agents made from single base and triple base tactical munition type gun propellants.

It is yet another object of the present invention to provide an economical means of disposing of single base and triple base tactical munition type gun propellants without having to rely on traditional disposal methods.

These and other objects of the present invention may be readily gleaned from the description of the invention which follows.

SUMMARY OF THE INVENTION

The present invention relates to the unexpected discovery that the use of a composition consisting essentially of small grain single base or triple base propellant in combination with a detonator and a booster, results in a blasting agent which has considerable commercial value. The resulting blasting agent exhibits favorable cost for performance characteristics.

In the present invention, a single base propellant consists essentially of at least about 75% by weight of explosive nitrocellulose in combination with stabilizers and other additives such as plasticizers, burning rate modifiers, stabilizers, flash depressants, among others, which are present in minor amounts. A triple base propellant consists essentially of at least about 15% by weight of nitrocellulose in combination with at least about 10% by weight of a secondary nitroester and with at least about 25% (up to about 50–60%) by weight of a high explosive such as nitroguanidine, RXD, HMX, among others, generally, in combination with stabilizers and other additives such as plasticizers, burning rate modifiers, stabilizers, flash depressants, etc.

The single or triple base propellants as described above are combined with a detonator and a booster in order to produce a blasting agent. It is an unexpected result that the inclusion of a single base or triple base propellant as described above will detonate when combined with a detonator and a booster.

In another aspect, the present invention relates to a method for the disposal of tactical muntion type gun propellants which could otherwise become an environmental liability, by producing a blasting agent composition consisting essentially of a single base or triple base propellant in combination with a detonator and a booster.

DETAILED DESCRIPTION OF THE INVENTION

As used throughout the specification, the following terms are applicable to describe the present invention.

The term "single base propellant" is used to describe a propellant composition (smokeless powder tactical munition type gun propellant) which consists essentially of at least about 75% by weight of explosive nitrocellulose in combination with minor amounts of additives such as plasticizers, burning rate modifiers, stabilizers, flash depressants, etc. Single base propellants find general use in the present invention in combination with a detonator and a booster.

The following two compositions are representative of single base propellants which are useful in the present invention:

| Component | Composition #1 Amount | Composition #2 Amount |
|---|---|---|
| Nitrocellulose | 85.00 + 2.00 | 90.00 + 2.00 |
| Potassium Sulfate | 1.00 + 0.30 | — |
| Lead Carbonate | 1.00 + 0.20 | — |
| Diphenylamine | 1.00 + 0.20 − 0.10 | 1.00 + 0.20 − 0.10 |
| Dinitrotoluene | 10.00 + 2.00 | 8.00 + 2.00 |
| Dibutylphthalate | 5.00 + 1.00 | 2.00 + 1.00 |

The term "double base propellant" is used to describe a propellant composition which consists essentially of at least about 50% by weight of explosive nitrocellulose and at least about 10% by weight of a secondary nitroester selected from nitroglycerine, diethyleneglycoldinitrate, among others, and with minor amounts of additives such as plasticizers, burning rate modifiers, stabilizers, flash depressants, etc. also included. In the present invention, double base propellants may be included along with single or triple base propellants as minor components in amounts which are less than about 50% by weight, and preferably less than about 30% by weight.

The following two compositions are representative of double base propellants which may be included as minor components in the present invention:

| Component | Composition #1 Amount | Composition #2 Amount |
|---|---|---|
| Nitrocellulose | 77.45 ± 2.00 | 52.15 ± 1.50 |
| nitroglycerinee | 19.50 ± 1.00 | 43.00 ± 1.50 |
| Ethylcentralite | 0.60 ± 0.15 | 0.60 ± 0.15 |
| Barium Nitrate | 1.40 ± 0.25 | — |
| Potassium Nitrate | 0.75 ± 0.20 | 1.25 ± 0.25 |
| Graphite | 0.30 ± 0.10 | — |
| Diethylphthalate | — | 3.00 ± 0.50 |

The term "triple base propellant" is used to describe a propellant composition which consists essentially of at least about 15% by weight of explosive nitrocellulose combined with at least about 10% by weight of a secondary nitroester and with at least 25% by weight of a high explosive such as nitroguanidine, RDX and HMX, among others, in combination with minor amounts of additives such as plasticizers, burning rate modifiers, stabilizers, flash depressants, etc. Triple base propellants find general use in the present invention in combination with a detonator and a booster.

The following two compositions are representative of triple base propellants which may be used in the present invention:

| Component | Composition #1 Amount | Composition #2 Amount |
|---|---|---|
| Nitrocellulose | 20.00 ± 1.30 | 28.00 ± 1.30 |
| nitroglycerinee | 19.00 ± 1.00 | 22.50 ± 1.00 |
| Nitroguanidine | 54.70 ± 1.00 | 47.70 ± 1.00 |
| Ethylcentralite | 6.00 ± 0.30 | 1.50 ± 0.10 |
| Potassium Sulphate | — | 1.00 ± 0.30 |

The term "detonator" is used to describe a device which produces sufficient shock energy to produce a detonation of an explosive material. A detonator may be typically comprised of a blasting cap which contains an aluminum or other metallic shell and an explosive material (such as lead azide, pentaerythritolpentanitrate (PETN), among others). Connected to the blasting cap is generally a wire or fuse which will carry an energy impulse sufficient to ignite the match which, in turn, detonates the explosive material in the blasting cap. The detonator produces sufficient force generally in the form of a shock wave to initiate an explosion. In the present invention, the pressure generated by the detonator is sufficient to detonate the booster. Detonators for use in the present invention are standard in the industry and may be purchased from any number of suppliers of commercial explosive equipment including ICI Explosives, Dallas, Tex., Dyno Nobel, Salt Lake City, Utah, Austin Powder, Cleveland, Ohio and related companies.

The term "booster" is used to describe material which is found in proximity to the detonator and which contains sufficient mass to provide the energy necessary to initiate the detonation of the single base or triple base propellants which are found in the blasting agents according to the present invention. Typically a booster of a mass of at least about ⅙ pound up to about 5 pounds or more is used in the present invention and is sufficient to initiate the detonation reaction of the single and/or triple base propellant material. Typical booster materials include for example, a mixture of TNT and PETN (50/50 or 55/45 by weight), among other materials, including dynamite or other cap sensitive material. The booster is generally initiated with a suitable initiating device such as an electric or non-electric detonator or detonating cord.

The term "small grain" is used to describe the size of single or triple base propellant particles which are used in the instant invention. In one aspect according to the present invention, it has been discovered quite unexpectedly that combining a single or triple base propellant having a grain size of about 1/16 inch up to about 1 inch diameter, more preferably about ⅛ inch up to about ½ inch diameter, will produce an explosive material when combined with a detonator and booster. Single and triple base propellants which have grain sizes outside of this range may be incorporated as minor components (less than about 50% by weight) in the present invention.

The term "secondary nitroester" is used to describe compounds which are included along with nitrocellulose and high explosives in triple base propellants which are used in the present invention. Typical secondary nitroesters include nitroglycerine, diethyleneglycoldinitrate, among others.

The present invention relates to the unexpected discovery that single or triple base military propellants having a grain size ranging from about 1/16 inch to about 1 inch diameter, preferably, about ⅛ inch to about ½ inch diameter can be detonated when combined with a detonator and a booster. This novel blasting agent is commercially viable and inexpensive for use as a commercial explosive. Use of single base and triple base propellants as blasting agents according to the present invention represents a novel way of disposing of these military propellants in an economically efficient manner.

Explosive nitrocellulose for use in the present invention is a nitrated cellulose material having about 10.5% to about 14%, preferably about 12–13%, by weight nitrogen. In general, the single base propellants which are used in the instant invention contain at least about 75% by weight of explosive nitrocellulose, whereas the triple base propellants contain at least about 15% by weight nitrocellulose. Single base propellants may also include minor amounts of plasticizers, burning rate modifiers, stabilizers, flash depressants and other additives. These additives are readily recognized by those of ordinary skill in the art for the characteristics these additives instill in the final propellants when they are included in effective amounts. In addition, single and triple base propellants may also include minor amounts of double base propellants and other additives including lubricants, such as graphite, among others.

The novel blasting agents according to the present invention may be used directly or packaged in plastic, paper or other packing material. The single or triple base propellants of grain size which is appropriate for use in the instant invention, when packaged as dry material, results in a certain void volume (because of the uneven shapes and sizes). Preferably, the package is cylindrical with a diameter of about 1.5 inch or more. The blasting agents may be used with the propellant packaged in the dry state or alternatively, water or an aqueous salt or other solution or liquid may be added to the the packaged material to fill the void volume.

In using the novel blasting agents according to the present invention, the single and/or triple base propellant in grain form may be used directly by placing quantities into a blasting (bore) hole having a diameter sufficient to allow detonation to occur. In general, the blasting hole is at least about 2 inches in diameter, but may change as a function of the type of propellant used and its sensitivity.

The following example is provided to illustrate the present invention and should not be misunderstood or misinterpreted to limit the scope of the present invention in any way.

EXAMPLE 1

Use of Propellants as Blasting Agents

In an attempt to establish the feasability of using or recycling tactical munition type gun propellants in commercial explosives, the LKL propellant was purchased from the IOWA Army Ammunition plant. The LKL propellant was described as follows:

LKL M865F
Single Base Propellant Explosive
Diameter=9 mm
Length=10 mm
Heat of explosion=880 cal/gm The propellant had the following formulation:

| Ingredients | Weight % |
|---|---|
| Nitrocellulose(13.2 +— 0.1% N) | 93.3 ± 2.5 |
| Dinitrotoluene | 3.0 +1.5 or −0.5 |
| Dibutylphthalate | 1.0 ± 0.3 |
| Diphenylamine | 1.5 ± 0.3 |
| Potassium Sulfate | 1.2 ± 0.3 |
| Graphite Glaze | 0.2 max. |

The propellant was evaluated to determine whether or not it would detonate on its own as an explosive. The propellant was poured into cardboard tubes and primed with a one-half pound cast booster. The poured propellant proved to have an average bulk density of about 1.00 g/cc. A particle density of 1.55 g/cc was measured on the propellant pellets. The detonation tests showed that the LKL propellant was capable of detonating in a 4 inch unconfined charge. When water was added to the propellant column in the charge, the unconfined 4-inch VOD was increased from 20,000 ft.sec to 23,000 ft/sec. A similar VOD increase can be found when adding water to a column of Nitropel™ TNT (a prilled commercial blasting agent available from ICI Explosives).

In addition to the VOD tests, the LKL propellant pellets were evaluated for explosive energy in the underwater energy test. The LKL pellets were loaded into 6-inch diameter 1 gallon plastic jars and primed with one pound cast boosters. The pellets were shot both with air and with water filling the interstitial spaces between the pellets. These test data are given in Table I, below. For comparative purposes, Nitropel™ prilled TNT was shot in a similar package, both dry and wet.

TABLE I

Underwater Energy Test Data
These energy test data were measured on 6 inch diamater unconfined charges (6 inch × 1 gallon jars for ANFO, TNT and straight LKL propellant), that were primed with Trojan 1 pound cast boosters. The charges were shot at 25° C. The test data is as follows.

| Product | Density (Kg/m$^3$ | VOD (m/sec) |
|---|---|---|
| ANFO (STD.) | 910 | 3,810 |
| LKL Dry | 1010 | 6,100 |
| LKL Wet | 1010 | 7,120 |
| Nitropel Dry | 1000 | 4,880 |
| Nitropel Wet | 1000 | 6,100 |

| Product | Shock Energy | Bubble Energy | Total Available Energy |
|---|---|---|---|
| ANFO (STD.) | 348 | 519 | 867 |
| LKL Dry | 405 | 456 | 861 |
| LKL Wet | 467 | 446 | 913 |
| Nitropel Dry | 399 | 460 | 859 |
| Nitropel Wet | 460 | 470 | 930 |

All of the above energy values are presented in calories/gram.

In these tests, the LKL single base propellant was found to be capable of detonating in a 4 inch unconfined charge with a VOD of 20,000 ft/sec dry and 23,400 ft/sec wet. In this condition, its density, velocity, and underwater energy values were comparable to that of Nitropel™ TNT prills, which indicated that the LKL pellets could be used as a substitute for Nitropel in toe-loading situations.

We claim:

1. A blasting agent consists essentially of single or triple base propellant grains having a grain size ranging from about 1/16 inch to about 1 inch diameter in combination with a detonator and a booster, said blasting agent being packaged with water or an aqueous salt solution to fill void volume.

2. The blasting agent according to claim 1 wherein said propellant is a single base propellant consisting essentially of at least about 75% by weight nitrocellulose.

3. The blasting agent according to claim 1 wherein said propellant is a triple base propellant consisting essentially of at least about 15% by weight nitrocellulose in combination with at least about 10% by weight of a secondary nitroester and at least about 25% by weight of a high explosive selected from the group consisting of nitroguanidine, RDX and HMX.

4. The blasting agent according to claim 1 further including a minor amount of a double base propellant.

5. The blasting agent according to claim 1 wherein said booster is a mixture of TNT and PETN.

6. A method for using excess single base or triple base propellent in a blasting agent which propellant might otherwise become an environmental liability consisting essentially of combining single or triple base propellant grains having a grain size ranging from about 1/16 inch to about 1 inch diameter with a detonator and a booster to produce a blasting agent, said blasting agent being packaged with water or an aqueous solution to fill void volume.

7. The method according to claim 6 wherein said propellant is a single base propellant consisting essentially of at least about 75% by weight nitrocellulose.

8. The method according to claim 6 wherein said propellant is a triple base propellant consisting essentially of at least about 15% by weight nitrocellulose in combination with at least about 10% by weight of a secondary nitroester and at least about 25% by weight of a high explosive selected from the group consisting of nitroguanidine, RDX and HMX.

9. The method according to claim 6 wherein said blasting agent further includes a minor amount of a double base propellant.

10. The blasting agent according to claim 6 wherein said booster is a mixture of TNT and PETN.

* * * * *